United States Patent [19]

Zivkovich

[11] Patent Number: 4,820,957

[45] Date of Patent: Apr. 11, 1989

[54] PROCESS FOR BURNING A CARBONACEOUS FUEL USING A HIGH ENERGY ALTERNATING CURRENT WAVE

[76] Inventor: Aleksandar Zivkovich, 7300 Cedar Post Rd., Liverpool, N.Y. 13088

[21] Appl. No.: 126,308

[22] Filed: Nov. 27, 1987

Related U.S. Application Data

[63] Continuation-in-part of Ser. No. 829,972, Feb. 18, 1986, Pat. No. 4,710,681.

[51] Int. Cl.[4] ..... F02P 9/00

[52] U.S. Cl. ..... 315/209 T; 123/607; 315/209 R; 315/209 SC

[58] Field of Search ..... 315/209 SC; 123/206, 123/606, 607, 608

[56] References Cited

U.S. PATENT DOCUMENTS

| | | | |
|---|---|---|---|
| 3,280,809 | 10/1966 | Issler | 123/148 E |
| 3,718,125 | 2/1973 | Posey | 123/148 E |
| 3,906,919 | 9/1975 | Asik et al. | 123/148 E |
| 4,161,936 | 7/1979 | Volsky | 315/209 T |
| 4,191,911 | 3/1980 | Gerry | 123/606 |
| 4,206,736 | 6/1980 | Gerry | 123/606 |
| 4,320,735 | 3/1982 | Canup | 123/606 |
| 4,328,771 | 5/1982 | Kawai | 123/179 |
| 4,359,998 | 11/1982 | Topic | 123/637 |
| 4,382,430 | 5/1983 | Iwasaki | 123/621 |
| 4,445,492 | 5/1984 | Rouanes | 123/607 |
| 4,522,185 | 6/1985 | Nguyen | 123/623 |
| 4,641,626 | 2/1987 | Morino | 123/621 |

FOREIGN PATENT DOCUMENTS

| | | | |
|---|---|---|---|
| 70572 | 1/1983 | European Pat. Off. | 123/148 E |
| 1569640 | 4/1969 | France | 123/148 E |
| 2101208 | 1/1983 | United Kingdom | 123/148 E |

OTHER PUBLICATIONS

Solid-State Devices manual, RCA Corp., 1975, pp. 282–290.

*Primary Examiner*—Leo H. Boudreau
*Assistant Examiner*—Brian Palladino
*Attorney, Agent, or Firm*—Wall and Roehrig

[57] ABSTRACT

An electronic ignition circuit for an internal combustion engine produces a plasma arc across the spark gap of an ignition device. An a.c. circuit is formed of a push-pull inverter, and a center tap primary step up transformer with feedback coil. A capacitor network passes pure a.c. to the primary of an ignition coil so that the wave fed to the ignition device is free of any d.c. component. An impedance connects to the breaker points or equivalent timing device to time the arcing so that an arcing a.c. voltage appears when the points are open, and a zero or low voltage wave appears when the points are closed. The circuit can also be used to feed a continuous wave to arcing devices in the cylinders of a diesel engine for preheating and ozonation of the air prior to fuel injection.

11 Claims, 2 Drawing Sheets

PROCESS FOR BURNING A CARBONACEOUS FUEL USING A HIGH ENERGY ALTERNATING CURRENT WAVE

RELATED INVENTION DATA

This is a Continuation-in-Part of my earlier copending application Ser. No. 829,972 filed Feb. 18, 1986, now U.S. Pat. No. 4,710,681, issued Dec. 1, 1987.

BACKGROUND OF THE INVENTION

This invention relates to an electronic ignition circuit that provides a high-frequency, high-voltage current wave to the ignition coil of an internal combustion engine or the like.

Conventional electronic ignition systems typically apply a pulse or spike of elevated voltage to the ignition coil primary, which provides a polar spark current to the center electrode of a spark plug. The current to the spark electrode is characterized by a single high voltage spike followed by a few progressively smaller waves of ringing current. Spark occurs only at the onset of ignition. As the piston descends during a power stroke, the combusting mixture expands adiabatically and cools. This can extinguish combustion in the combustion chamber, resulting in incomplete combustion, loss of power, and possible fouling of spark plugs and valves.

Ignition circuits typically supply polar current (usually positive-only) to the spark plugs; this produces a d.c. current flow in the plugs, which causes pitting of the spark electrodes. Also, as conventional circuits produce sparking, rather than continuous arcing, ignition and combustion are less reliable, especially in a cold engine.

OBJECTS AND SUMMARY OF THE INVENTION

It is an object of the invention to provide an electronic ignition circuit which avoids the drawbacks of the prior art, produces a continuous a.c. power wave of high-frequency high voltage current, and causes arcing across the spark gap of a spark plug or like device during an ignition interval.

It is another object of the invention to provide such an ignition circuit which yields reduction in uncombusted fuel, and increased power and fuel economy.

According to an aspect of this invention, an electronic circuit applies a high-frequency, high-voltage wave to a spark gap of a spark ignition device in a combustion chamber of an internal combustion engine or the like. An a.c. circuit provides an alternating-current, high-voltage, high-frequency wave to a primary of an ignition coil whose secondary is connected to the spark gap. A timing circuit is connected to the a.c. circuit to control the wave so that it is provided during ignition intervals at a peak voltage that is sufficient to arc across the gap. In this ignition circuit, the wave provided to the spark gap has a peak voltage of from 25 KV to 200 KV and a frequency of about 8 KHz to 80 KHz. The a.c. circuit provides the wave at a constant frequency, and the timing circuit is coupled to the a.c. circuit so as to provide the wave, during the ignition intervals, at the peak voltage so that there is arcing across the gap, but during the intervals between successive ignition intervals, at a peak voltage insufficient to arc across the gap. The peak voltage, for example, can be from zero volts to five kilovolts. The wave maintains the predetermined frequency during these intervals. This ensures that at the commencement of each ignition interval, the wave at high voltage will appear within one cycle.

The a.c. circuit favorably includes a d.c.-d.c. converter that has a step-up transformer with a feedback winding that controls a pair of transistors connected in push-pull to a primary thereof, and also controls a chopper circuit that can include an SCR. A capacitor network sharpens the wave and removes the d.c. component therefrom.

DESCRIPTION OF THE PREFERRED EMBODIMENT

Figure 1:
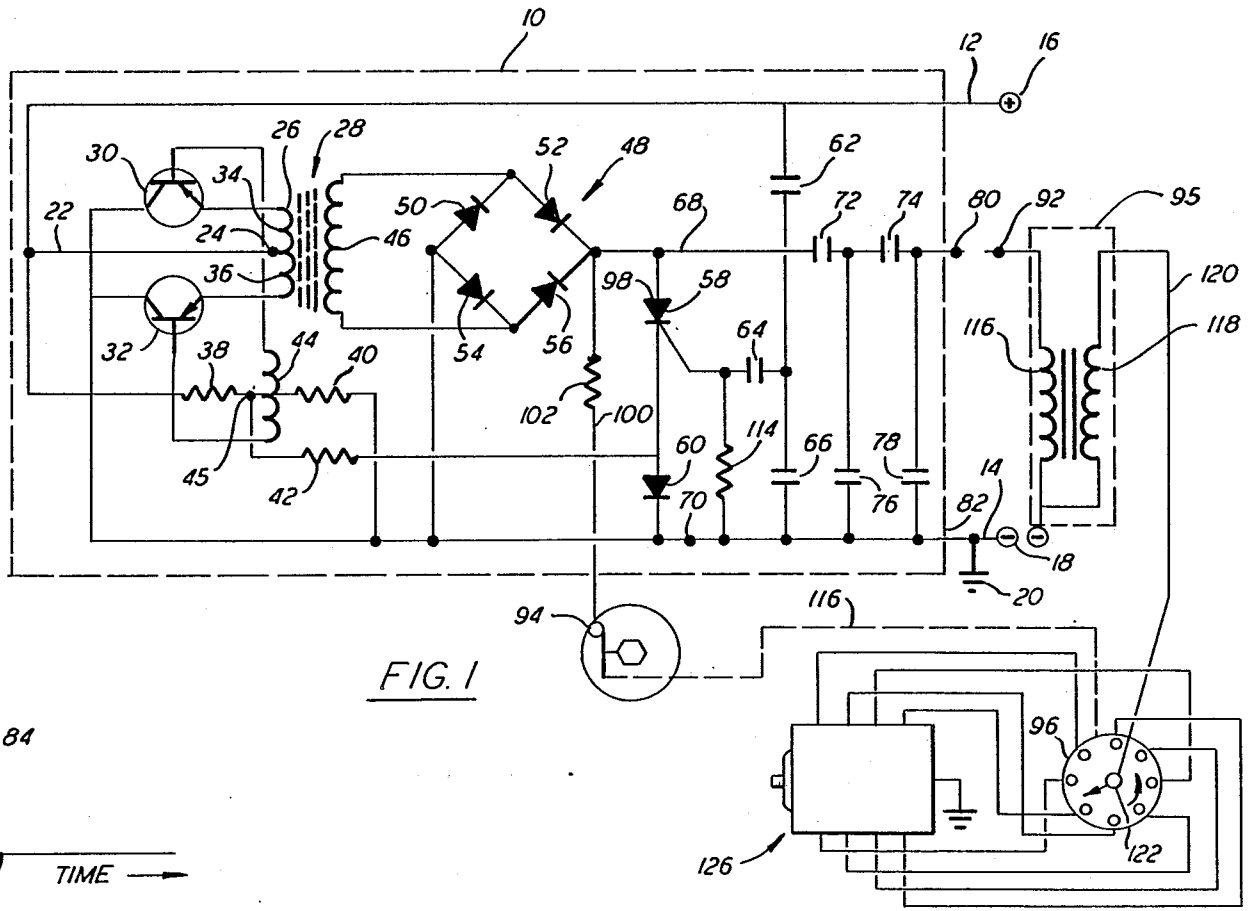
FIG. 1 is a schematic diagram of an electronic ignition circuit that embodies this invention.

FIG. 1 illustrates one embodiment of the ignition system of this invention for an automotive 4-stroke internal combustion gasoline engine. The invention can be used with other engines, including 2-cycle engines, 4-cycle engines, diesel engines, stirling engines, and for automotive, marine, and aircraft uses.

As is shown in FIG. 1, a source of direct current, such as an automotive battery, is applied across lines 12 and 14. The battery positive pole 16 connects to line 12, and the negative pole 18 to line 14 and to ground 20.

When an ignition switch (not shown) is closed, voltage is supplied through line 12 and line 22 to transformer center junction 24 in the primary 26 of a step-up transformer 28.

The battery current is inverted ahead of the step-up transformer 28. An inverter circuit is comprised of switching transistors 30 and 32. Direct current flows to transformer junction 24 and through primary winding 26, which is comprised of upper section 34 and lower section 36, joined at center-tap junction 24. The flux density in the transformer core varies between the saturation value in one direction and the saturation value in the opposite direction. At the start of the conduction period for one transistor, the flux density in the core is saturated at either its maximum negative value (−B) or its maximum positive value (+B). Transistor 30 switches on at −B saturation. During conduction of transistor 30, the flux density changes from its initial level of −B saturation and becomes positive, as energy is simultaneously stored in the inductance of the transformer. When the flux density reaches +B saturation, transistor 30 is switched off and transistor 32 is switched on. The transformer 28 assures that energy is supplied at a constant rate during the entire half cycle that transistor 30 conducts. The remaining half cycle occurs when transistor 32 conducts. Initially, sufficient bias is applied to saturate transistor 30. As a result, a substantially constant voltage waveform is produced in the primary winding. In this push-pull-coupled converter, the transition to "switch-off" is initiated when the transformer begins to saturate. So long as the transistor is not saturated, the product of the transformer inductance and the time rate of change of the collector current remains constant. When the transformer core is saturated, however, the inductance decreases rapidly toward zero, with the result that the time rate of change of the collector current increases toward infinity. When the collector current reaches its maximum value, transistor 30 moves out of saturation and the winding voltage decreases and then reverses, thereby causing transistor 30 to switch off. The reversal of the winding voltage switches transistor 32 on, and the switching operation is repeated as long as current is supplied.

The bases of the switching transistors 30, 32 must be biased as suitable. Resistors 38, and 40 act as voltage dividers and provide the proper bias to the bases of transistors 30 and 32 and another resistor 42 is coupled to the junction of resistors 38, 40.

Feedback winding 44 is connected between the base of transistor 32 and the base of transistor 30. When the current through the upper half 34 of the primary transformer winding 26 no longer can increase because of resistance in the primary circuit and/or transformer core saturation, the signal applied to the transistor 32 drops to zero, turning transistor 32 off. The current in this feedback winding 44 immediately starts decreasing, causing a collapse of the magnetic field. This collapsing field, cutting across all the winding in the transformer, develops voltages in the transformer opposite in polarity to the voltage developed by the expanding field. This voltage now drives transistor 32 into cutoff and transistor 30 into conduction. This action converts the applied battery voltage into an alternating current.

The alternating current produced by the converter circuit using transistors 30 and 32 is a square wave a.c.; likewise, the alternating current produced in the secondary 46 of transformer 28 is square-wave a.c. of higher voltage. The square-wave a.c. from the transformer is transformed into pulsating d.c. by a full-wave bridge rectifier 48.

One may use a light-activated silicon controlled rectifier ("LASCR") as a triggering device in place of points. If it is desired to use such a device, it could be connected at the center tap 45 of feedback winding 44.

The voltage developed across secondary winding 46 of transformer 28 should be from about 100 to 400 volts, preferably 200 to 400 volts.

The output from secondary winding 46 is fed into the fullwave rectifier bridge 48 to produce a d.c. voltage of from about 200 to about 400 volts. Any suitable full-wave rectifier can be used. This full-wave rectifier 48 is comprised of diodes 50, 52, 54, and 56.

The output from full-wave rectifier 48 is converted into a high-frequency alternating current (a.c.) wave with a frequency of from about 8,000 to about 80,000 cycles per second. Many means are known to those skilled in the art for converting a fully rectified d.c. wave with a voltage of from about 200 to about 400 volts into a high-frequency a.c. wave.

One suitable conversion means is illustrated in FIG. 1. This conversion means is comprised of resistor 42 which supplies a positive voltage signal to control a silicon controlled rectifier (SCR) 58 which chops high-voltage d.c., a diode 60 (which ensures the supply of some positive voltage to the SCR cathode), and capacitors 62, 64, and 66 which are used to transfer a positive signal to the gate of the silicon controlled rectifier.

The SCR acts as a chopper and produces an alternating current with a frequency of from about 8,000 to about 50,000 Hertz, as measured between points 68 and 70. It is preferred that this frequency be from about 25,000 to about 35,000 Hertz, at a voltage of from about 200 to about 400 volts.

Diodes 50, 52, 54, 56 and 60 can be IN 4004 diodes, or other suitable diodes.

SCR 58 produces an output wave across points 80 and 82 with substantially the same frequency as the output from secondary winding 46. This is accomplished with the use of two inputs to SCR 58. The first input, which flows to SCR 58 when the output wave from winding 46 has a positive amplitude, flows from point 68 to an anode 98 of the SCR 58, while the gate thereof is connected to the junction of capacitor 62 and capacitor 66 through capacitor 64; this input turns on the SCR 58. The second input, which flows to silicon controlled rectifier 58 when the output wave from winding 46 also has a positive amplitude, flows from point 45 through resistor 42 to the cathode of the SCR 58.

Both inputs to silicon controlled rectifier 58 are square wave a.c. waves, separated in phase by 180 degrees.

The circuit described in FIG. 1 achieves the desired waveform with only a single oscillator for converting the direct current. This arrangement is far more economical than those that required two or more oscillators for the same purpose. This unique arrangement produces a high-energy, high-voltage, high frequency alternating current wave which is suitable for igniting such fuels as natural gas, hydrogen, gasoline, kerosene, alcohol, and the like; moreover, the power wave of this circuit can be used in any engine which utilizes a spark plug or a glow plug for combustion. Furthermore, the wave can be used to ignite rocket engines, or to detonate explosives, or to ignite other combustible materials.

The combustion chamber in which the wave is utilized has a spark gap, i.e., a region between two electrodes in which a disruptive discharge can take place.

The output wave from SCR 58 is passed through series capacitors 72 and 74 and capacitors 76 and 78. The function of these capacitors is to act as a network to sharpen the output wave, and remove any d.c. component. Capacitors 72 and 74 are rated at 2 microfarads and 600 volts, capacitor 76 is rated at 0.02 microfarads, and capacitor 78 is rated at 0.033 microfarads. Both capacitors 76 and 78 should be rated at least 1,000 volts.

Figure 2:
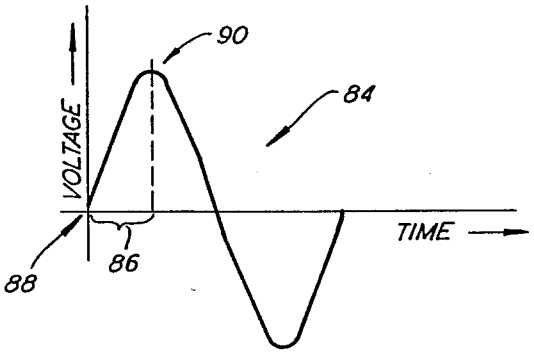
FIGS. 2 and 3 are waveform graphs for explaining the operation of the embodiment of FIG. 1.

The output measured across points 80 and 82 is a high-frequency alternating current wave with a rise time of from about 3 to about 30 microseconds, and this "rise time" is illustrated in FIG. 2, where a cycle 84 of the output wave is shown. The time 86 it takes for the wave to go from the zero point 88 to its peak 90 is the "rise time." The rise time of the wave should be from about 4 to about 20 microseconds, and preferably from about 4 to about 10 microseconds.

Output electrodes for high-frequency module 10 are points 16, 18, 92 and 94. Point 16 connects the positive end of the battery with the high-frequency module 10. Point 18 connects via ground 20 to the negative end of the battery. Point 92 is an output line connecting the shaped output from the high-frequency module to the coil. Point 94 connects the high-frequency module to the triggering device 96.

The triggering device 96 may be a conventional distributor comprised of breaker points.

The triggering device 96 may be light-activated silicon controlled rectifier (LASCR). Thus, e.g., one can use an optical sensor.

The output from full-wave rectifier 48 is connected to the anode 98 of silicon controlled rectifier 58; and it is also connected to triggering device 96 through line 100. Intermediate full wave rectifier 48 and triggering device 96 is resistor 102. This resistor 102 serves a very important function in high-frequency module 10 this ensures that the output across points 80 and 82 is continuous even when the points in the triggering device 96 are closed.

Figure 3:
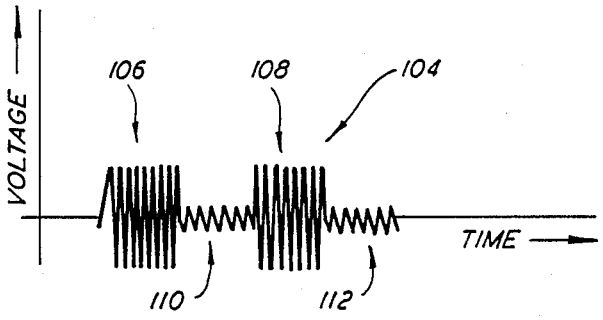

Resistor 102 ensures that the output at points 80 and 82 will be a continuous-oscillation, varying voltage, alternating current wave, illustrated in FIG. 3. Here, wave 104 has its maximum amplitude at ignition intervals 106 and 108 when the breaker points of the triggering device 96 are open, and a minimum amplitude at the remaining intervals 110 and 112 when the points of device 96 are closed. The intervals 106,108 represent the ignition dwell, and are preferably about 5 to 90% of the power stroke, yet more preferably about 10 to 50% of the power stroke. The intervals 106,108 can be, for example, 50% of the power stroke. The wave always has some finite a.c. voltage level; thus, it is continuous. The maximum peak voltage at times 106 and 108 is from about 200 to about 400 volts; the minimum voltage peak, at times 110 and 112, is from 2 volts to about 15 volts, but could be zero volts. Resistor 114 ensures that the gate of SCR 58 is positive and has a bias of up to about 2 volts. The output from the high-energy module 10 is connected to a primary winding 116 of the ignition coil 95 by conductors 92 and 94. Connector 94 feeds output from high-energy module 10 through triggering device 96. Any conventional ignition coil can be used. The output from the secondary winding 118 of ignition coil 95 is fed through line 120 to the center 122 of the distributor. The triggering device—distributor 96 distributes the high-frequency, high-voltage waveform to the spark plugs of engine 126.

When the points of triggering device 96 are open, the output from secondary 120 will be a high-voltage, high-frequency wave. In a preferred embodiment, the output wave will have a frequency of from about 12,000 to about 45,000 cycles per second and a voltage of from about 25,000 to about 100,000 volts (peak). In the device described in the following examples, the output wave was an a.c. wave with a peak voltage of about 80,000 volts and a frequency of about 30 KHz.

As long as the points of triggering device 96 are open, a high-energy plasma arc appears across the electrodes of the spark plug. As used in this specification, the term "arc" refers to a plasma discharge of electric current crossing a gap between two electrodes. Unlike conventional spark ignition systems, the arc created in the ignition system of this invention exists for as long as the breaker points of the triggering device 96 are open the duration of the energy imparted to the spark plug is much greater with the arc than with the spark. The low voltage wave that continues over the spans 110,112 between successive ignition intervals 106,108 ensures that the high voltage wave will commence immediately at the leading edge of the ignition intervals 106,108, i.e., within a half-cycle. This is an operative consideration, and other means could be employed within the scope of this invention to ensure that arcing will commence within the first cycle of the wave 104 after the leading edges of the ignition intervals. This would permit the voltage level in the spans 110,112 to be any low voltage, down to zero volts, if desired, and up to 50 kilovolts.

Although the invention has been described with reference to use in an internal combustion engine, it can be utilized in any combustion chamber with a spark gap in which carbonaceous fuel is present. A diesel engine could employ this device with continuous arc devices in lieu of glow plugs.

Figure 4:
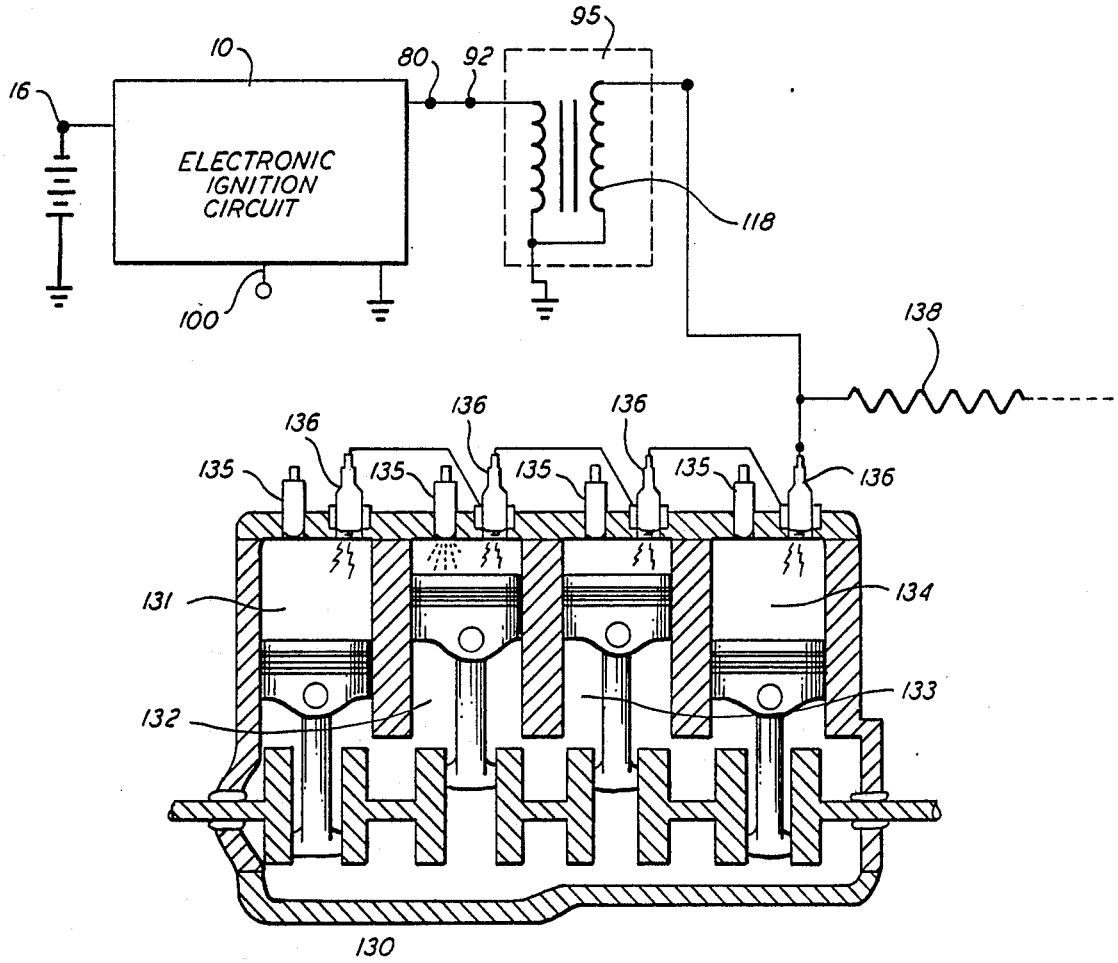
FIG. 4 shows an application of this invention in a diesel engine.

As illustrated in FIG. 4, the ignition circuit 10 can be employed in association with a diesel engine 130. Here the engine is a four-cylinder inline four-cycle engine with cylinders 131 to 134. Each cylinder is provided with a fuel injector 135 and a spark plug 136. The plug 136 is insulated from the engine head except that the plug 136 for the number one cylinder 131 is grounded to the engine 130.

The ignition circuit 10 is powered from a DC source 16, such as the engine battery, and energizes the primary winding 116 of a standard ignition coil 95. The ignition coil secondary 118 is connected directly only to the center electrode of the spark plug 136 of the number four cylinder 134. The plugs 136 are cascaded, i.e., connected in series, with the outer electrode of the number four cylinder plug being connected to the center electrode of the plug 136 of the number three cylinder 133, and likewise connecting the plugs of the number two cylinder 132 and the number one cylinder 131, with the outer electrode of the latter plug being grounded. This series connection ensures that those will be an arc across the spark gap of each plug 136, not only that which would provide a least resistance path.

In this case, the line 100 to the triggering device is not used, and a continuous high-voltage, high-frequency pure AC wave 138 is generated. Arcing is continuous in all of the cylinders 131–134. This means that in the diesel engine 130, the spark plugs 136 function as glow plugs, and pre-condition the intake air in the cylinders during compression. Ignition takes place when the associated injector 135 injects the fuel as mist into the cylinder, here as illustrated in the number two cylinder 132. The continuous arcing during the downstroke diminishes the tendency for the combustion to extinguish when the cylinder descends to expand and cool the fuel and air in the cylinder. The arcing that occurs during intake and compression phases is believed to generate a significant amount of ozone which further facilitates complete combustion.

When this invention is applied to a diesel engine in the above fashion, the engine produces steady reliable power and remarkably produces very little black exhaust during start up and during acceleration.

Because the wave 138 that is fed to the plugs 136 is pure AC and because the wave has a high frequency on the order of 8 to 80 KHz, the electrodes of the spark plugs 136 will not pit or corrode, even though the arcing is continuous and over a long time.

While this engine 130 has four cylinders, it should be understood that the number of cylinders is not critical.

In each of the following examples, an ignition system comprised of the circuit shown in FIG. 1 was used.

In accordance with the arrangement disclosed in FIG. 1, this circuit was incorporated into the wiring system of an automobile, a 1977 Pontiac Grand Prix equipped with an 8-cylinder, 301 cubic inch engine. Regular fuel (87 octane) was used. The catalytic converter on the car was rendered inoperative—all of the material in the converter, including the catalyst, was removed.

EXAMPLE 1

The applicant took 46 trips in the car from Rochester, N.Y. to Syracuse, N.Y. on the New York State Thruway (Interstate 90). A flow meter was attached to the car, and the amount of fuel consumed after the car had travelled exactly 50 miles was noted. The car was equipped with a cruise control, and a speed of 55 miles per hour was maintained for each of these trips. The average fuel mileage obtained in the experiments of this example was 36.89 miles per gallon.

The official government mileage estimate for this car, equipped with a functioning catalytic converter, is only 23 miles per gallon (see, e.g. "1977 Gas Mileage Guide", 2d Ed., U.S. Environmental Protection Agency, January 1977). That comparative mileage data was derived at a more economical speed of 50 miles per hour.

EXAMPLE 2

The exhaust emissions of the car equipped with this ignition system were tested by Koerner Ford of Rochester, Henrietta, N.Y., U.S.A. The testing was conducted with a "Rotunda" exhaust emission tester; during the test the car's engine was run at 2000 revolutions per minute, the engine air intake temperature was 69 degrees Fahrenheit, and the exhaust temperature was 112 degrees Fahrenheit.

The exhaust from the car contained 0.17% of carbon monoxide, 140 parts per million of hydrocarbon, 14.9% of carbon dioxide, and 1.8% of oxygen.

COMPARATIVE EXAMPLE 3

In substantial accordance with procedure of Example 2, the exhaust emissions from the same car were tested by Koerner Ford of Rochester. However, for this test the high-frequency ignition system had been removed from the wiring system.

The exhaust from the car contained 4.74% of carbon monoxide, 1,291 parts per million of hydrocarbon, 11.4% of carbon dioxide, and 2.0% of oxygen.

What is claimed is:

1. An electronic ignition circuit for applying a high-frequency, high-voltage wave to a spark gap of a spark ignition device in a combustion chamber comprising an a.c. circuit providing an alternating-current, high-voltage high-frequency wave to a primary of an ignition coil whose secondary is connected to said spark gap, and a timing circuit connected to said a.c. circuit to control said wave so that the wave is provided during ignition intervals at a peak voltage sufficient to arc across said gap; wherein said wave provided to said spark gap has a peak voltage of from 25 KV to 200 KV and a frequency of about 8 KHz to 80 KHz, said a.c. circuit provides said wave at a continuous frequency, and said timing circuit is coupled to said a.c. circuit so as to provide said wave during ignition intervals at said peak voltage so that the wave voltage is sufficient to arc across said gap, and wherein during the intervals between successive said ignition intervals there is insufficient voltage to arc across said gap, said timing circuit including means to ensure that arcing will commence within substantially one cycle of the wave after the leading edge of each of said ignition intervals.

2. An electronic ignition circuit according to claim 1 wherein said insufficient voltage during the intervals between successive ignition intervals is substantially zero.

3. An electronic ignition circuit according to claim 1 wherein said insufficient voltage during the intervals between successive ignition intervals is in the range from zero to five thousand volts.

4. An electronic ignition circuit according to claim 1 wherein said combustion chamber includes a piston which periodically descends to define a power stroke, and said ignition interval has a duration of on the order of 5 to 90% of said power stroke.

5. An electronic ignition circuit according to claim 4 wherein said ignition interval duration is substantially 50% of said power stroke.

6. An electronic ignition circuit according to claim 1, wherein said a.c. circuit includes d.c. blocking means in advance of said ignition coil primary to remove and d.c. component from the wave furnished to the ignition coil.

7. An electronic ignition circuit according to claim 1 wherein said wave has a frequency of at least 25 KHz.

8. An electronic ignition circuit for applying a high-frequency, high-voltage wave to a spark gap of an arcing device in a combustion chamber of an internal combustion engine comprising an ignition coil having a primary winding and a secondary winding, and an a.c. circuit providing an alternating-current high-voltage wave to the primary winding of the ignition coil, whose secondary is connected to said spark gap, wherein the wave provided to said spark gap has a peak voltage of from 25 KV to 200 KV and a frequency of about 8 KHz to 80 KHz, said a.c. circuit provides said wave continuously at said frequency, so that continuous arcing occurs in said combustion chamber during all phases of the engine operation.

9. An electronic ignition circuit according to claim 8 wherein said interval combustion engine is a reciprocating diesel engine having plural cylinders, and each said cylinder defines a separate combustion chamber with a respective arcing device therein having a pair of electrodes, with the electrodes of all said arcing devices being connected in series between said secondary winding and ground.

10. An electronic ignition circuit according to claim 8 wherein said a.c. circuit includes d.c. blocking means in advance of said ignition coil primary winding for removing any d.c. component from the wave furnished to the ignition coil.

11. An electronic ignition circuit according to claim 8 wherein said wave has a frequency of at least 25 KHz.

* * * * *

UNITED STATES PATENT AND TRADEMARK OFFICE

CERTIFICATE OF CORRECTION

PATENT NO. : 4,820,957

DATED : April 11, 1989

INVENTOR(S) : Aleksandar Zivkovich

It is certified that error appears in the above-identified patent and that said Letters Patent is hereby corrected as shown below:

On the front page of the Patent, the inventor's address is incorrect, and should read 1217 S. Old Wilke Road, Arlington Hts., Illinois 60005.

Col. 8, line 21, please change "and" to --any--.

Signed and Sealed this

Thirtieth Day of January, 1990

*Attest:*

JEFFREY M. SAMUELS

*Attesting Officer* *Acting Commissioner of Patents and Trademarks*